US006158060A

United States Patent [19]

Wheeler

[11] Patent Number: 6,158,060

[45] Date of Patent: Dec. 12, 2000

[54] TOILET SEAT COVER ASSEMBLY

[75] Inventor: Robert L. Wheeler, Monrovia, Calif.

[73] Assignee: Acorn Engineering Co.,, City of Industry, Calif.

[21] Appl. No.: 09/395,271

[22] Filed: Sep. 13, 1999

[51] Int. Cl.[7] ..... E03D 11/00

[52] U.S. Cl. ..... 4/254; 4/237; 4/664

[58] Field of Search ..... 4/663, 664, 234, 4/254

[56] References Cited

U.S. PATENT DOCUMENTS 2,198,605 4/1940 Faber ..... 4/663
2,907,048 10/1959 Gould ..... 4/664 X
3,124,808 3/1964 Tiller ..... 4/664

*Primary Examiner*—Charles E. Phillips
*Attorney, Agent, or Firm*—Edgar W. Averill, Jr.

[57] ABSTRACT

A toilet seat cover assembly for use as a combination toilet seat cover and auxiliary bathroom seat with self-positioning, retractable backrest. The assembly includes a cover which is hinged to either the toilet or a housing structure positioned on either side of the toilet. A backrest having a base portion and an adjoining upright portion is hinged to the cover at the base portion such that when the cover is raised from a closed position to an open position, the backrest pivots with the cover until it contacts a stopper. At such point, and as the cover is continuously raised, the stopper urges the backrest to hinge separately from the cover and to retract in a compact manner.

5 Claims, 5 Drawing Sheets

TOILET SEAT COVER ASSEMBLY

BACKGROUND OF THE INVENTION

The field of the invention generally pertains to toilet seat covers. The invention relates more particularly to a toilet seat cover assembly for use as a combination toilet seat cover and auxiliary bathroom seat with self-positioning, retractable backrest.

Bathrooms have traditionally been the smallest room in virtually all institutions and homes. Much of the bathroom space is typically reserved for such traditional bathroom fixtures as a bathtub or shower, a wash basin, and a toilet. Unfortunately, this leaves very little free space available for even small furniture items, such as a chair, for momentarily sitting and resting. A place to sit in the bathroom is often needed, however, for handicapped persons, convalescents, senior citizens, or anyone who fatigues easily. In many cases, the availability of a place to sit in the bathroom can significantly reduce the risk of falling and injuring oneself.

Due to the inadequate space, conventional toilet seat covers have often been used as provisional, impromptu bathroom chairs when necessary. However, because toilet seat covers are not particularly designed for use as a seat, they are unable to comfortably support a seated person as would a typical chair. For example, unlike a chair, neither the toilet seat cover or the toilet itself provides any back support when a person sitting on the toilet seat attempts to lean back. While some toilets incorporate the use of water tanks, they are not designed or suited to support a lateral force applied by a person leaning against it. Additionally, with the exception of some toilets especially made for use by handicapped persons, the height of the toilet seat and toilet seat cover when lowered is typically lower than an average-sized chair, which can make sitting and standing up much more difficult.

In light of these and other limitations of the conventional toilet seat cover, various toilet seat covers and accessories have been developed to improve the utility, comfort, and/or aesthetic appearance of the conventional toilet seat cover, as well as the toilet seat and toilet in many cases. In most cases, however, the need to provide a comfortable, chair-like seating area in the bathroom while conserving space has been ill-addressed, if at all.

For example, in U.S. Pat. No. 2,434,889, a toilet seat accessory is shown for use as a combination toilet seat cover and auxiliary juvenile toilet seat. The auxiliary juvenile toilet seat is hinged to a conventional toilet seat, and a backrest separately hinged to the auxiliary juvenile toilet seat. Use of the backrest, however, is limited only for children and not adults. Additionally the backrest can only be used in conjunction with the auxiliary juvenile toilet seat, which may often be unnecessary. Further, because the hinging action of the backrest is independent of the hinging action of the auxiliary juvenile seat, this requires multiple independent actions by the user to correctly set up and use the backrest instead of one. And finally, the backrest disclosed in the '889 patent is not designed or suited to rest or lean against at all. As shown in FIG. 6 of the '889 patent, although the stop member 28 and resilient spring member 27 function to prevent the support member 24 from moving up in the slot 26, there is nothing to prevent the support member 24 from moving down and exiting the slot 26. This is particularly true when a lateral force is applied, such as that exerted by a person leaning against the backrest.

Additionally, U.S. Pat. No. 4,368,551 discloses a commode enclosure with a bottom closure cabinet and a top closure cabinet, for completely enclosing a toilet and water tank. The bottom closure cabinet has a hinged seating portion capable of swinging open to allow access to a toilet seat and the toilet. While the commode enclosure may be used as a seating area, it is essentially designed to enhance the aesthetic appearance of the conventional toilet. The all-enclosing features of the bottom and top closure cabinets are intended to cover up the drab and ordinary appearance of the conventional toilet bowl. It does so, however, by conspicuously taking up an extensive amount of bathroom space. Moreover, its demanding space requirement is compounded by its inability to completely retract or store away when accessing the toilet, which may cause discomfort or otherwise interfere with the conventional manner in which the toilet and toilet seat are used.

BRIEF SUMMARY OF THE INVENTION

It is an object of the present invention to provide a simple and compact toilet seat cover assembly which economizes bathroom space by functioning as a combination toilet seat cover and an auxiliary bathroom seat.

It is a further object of the present invention to provide a comfortable toilet seat cover assembly which provides a comfortable, chair-like bathroom seat having a backrest and an easily manageable seat elevation for sitting down and standing up.

It is a still further object of the present invention to provide a simple, easy-to-operate toilet seat cover assembly with a retractable backrest capable of self-positioning itself during operation of the toilet seat cover assembly.

It is a still further object of the present invention to provide a non-obtrusive toilet seat cover assembly which installs and operates without interfering with the underlying movement and operation of the conventional toilet seat (and conventional toilet seat cover if attached).

The present invention is for a toilet seat cover assembly for use with a toilet having a hinged toilet seat and functioning as a combination toilet seat cover and auxiliary bathroom seat with self-positioning, retractable backrest. The toilet seat cover assembly includes a cover having a platform portion with a top surface and a bottom surface, and a perimeter sidewall portion below the bottom surface of the platform portion with a pair of ends and a top edge joined to the platform portion. In a first preferred embodiment, the toilet seat cover assembly includes a housing structure having a pair of vertical sidewalls positioned on opposite sides of the toilet and rigidly joined together by a connector wall. In the first preferred embodiment, the perimeter sidewall portion is hingedly secured to the pair of vertical sidewalls by means for hingedly securing the cover to the pair of vertical sidewalls. In a second preferred embodiment, the perimeter sidewall portion is hingedly secured to the toilet by means for hingedly securing the cover to the toilet. In both the first and the second preferred embodiments, the means for hingedly securing the cover has a pivot axis extending through the pair of ends of the perimeter sidewall portion and parallel to a pivot axis of the hinged toilet seat. Additionally, the means for hingedly securing the cover functions to pivot the cover between a closed position over the hinged toilet seat and an open position remotely pivoted away from the hinged toilet seat. The toilet seat cover assembly also includes a backrest having a base portion with an upper surface and a lower surface, and an upright portion with a front surface, a rear surface, an upper end, and a lower end joined to the upper surface of the base portion. The base portion is hingedly secured to the cover by backrest hinging means, and contacts the cover along the lower surface when in the closed position. The toilet seat cover assembly also has means for actuating the backrest hinging means when the cover is moved between the open and closed positions. Preferably, the means for actuating the backrest hinging means is a stopper positioned behind the upright portion of the backrest facing the rear surface, and is affixed between the pair of vertical sidewalls of the housing structure in the first preferred embodiment. In both the first and second preferred embodiments, the rear surface comes into sliding contact with the stopper, which then operates to position the upright portion generally parallel to the cover when in the open position and generally perpendicular to the cover when in the closed position.

DETAILED DESCRIPTION OF THE PREFERRED EMBODIMENTS

Figure 1:
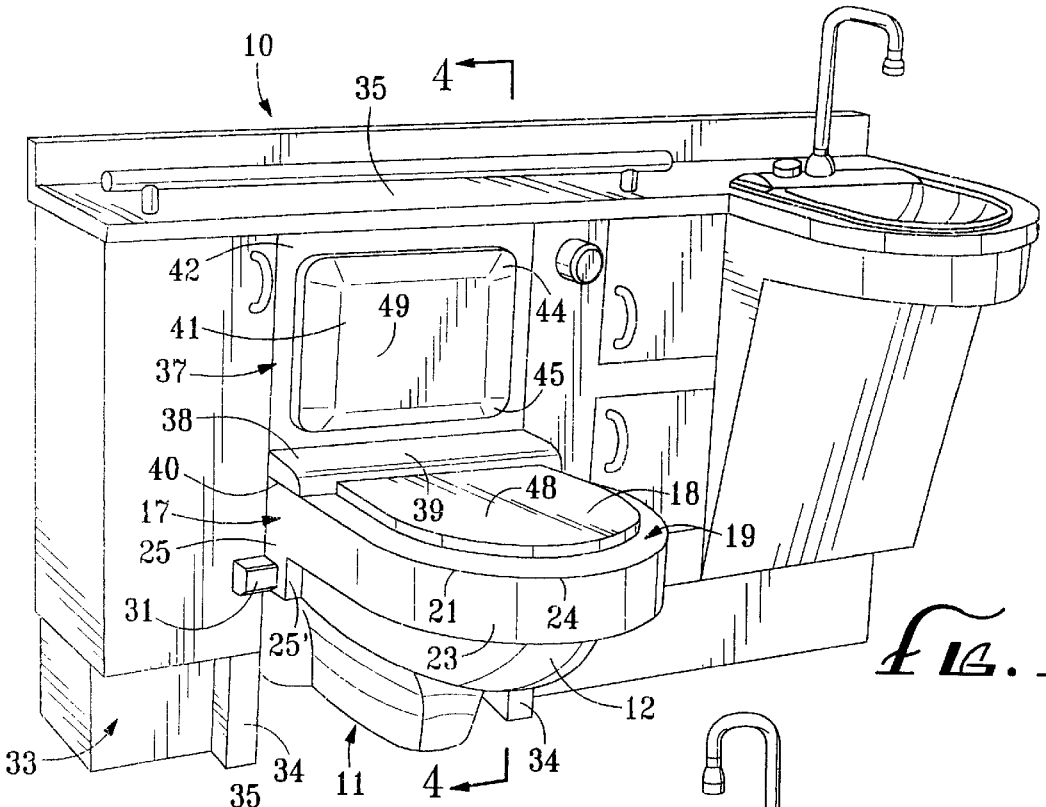
FIG. 1 is a perspective view of the first preferred embodiment of the toilet seat cover assembly as generally seen from the left side and in the closed position.
Figure 2:
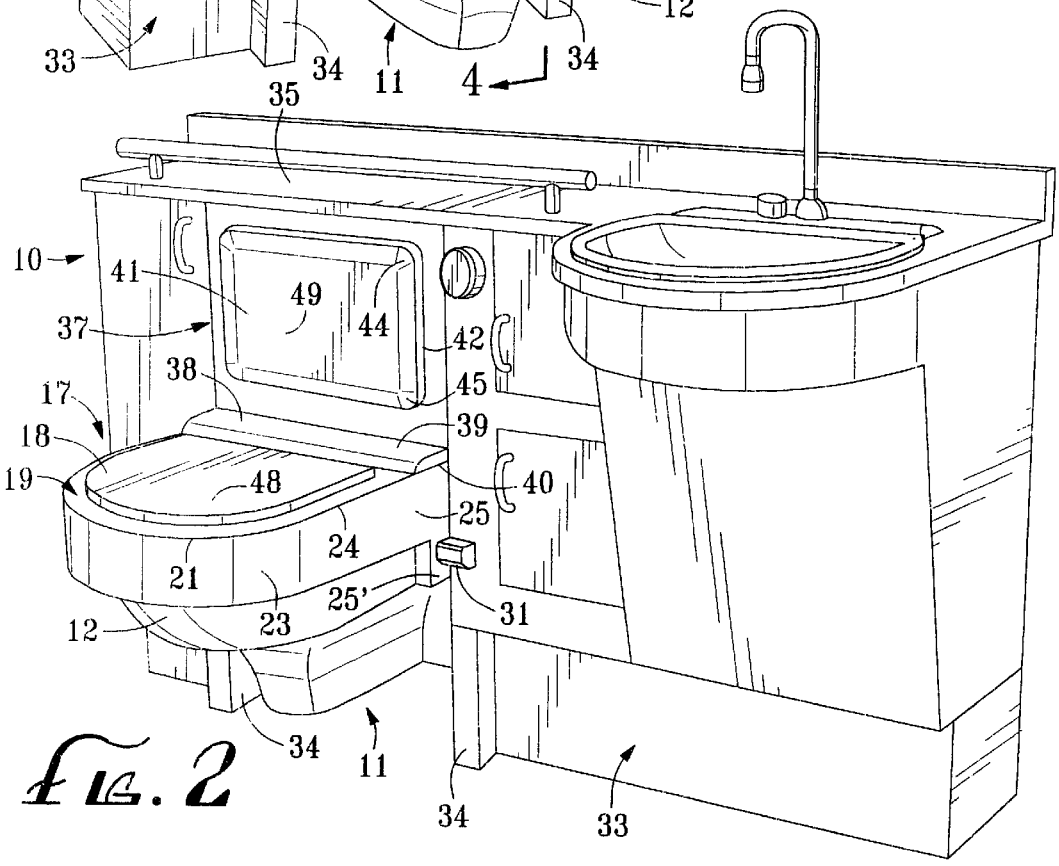
FIG. 2 is a perspective view of the first preferred embodiment of the toilet seat cover assembly as generally seen from the right side and in the closed position.
Figure 3:
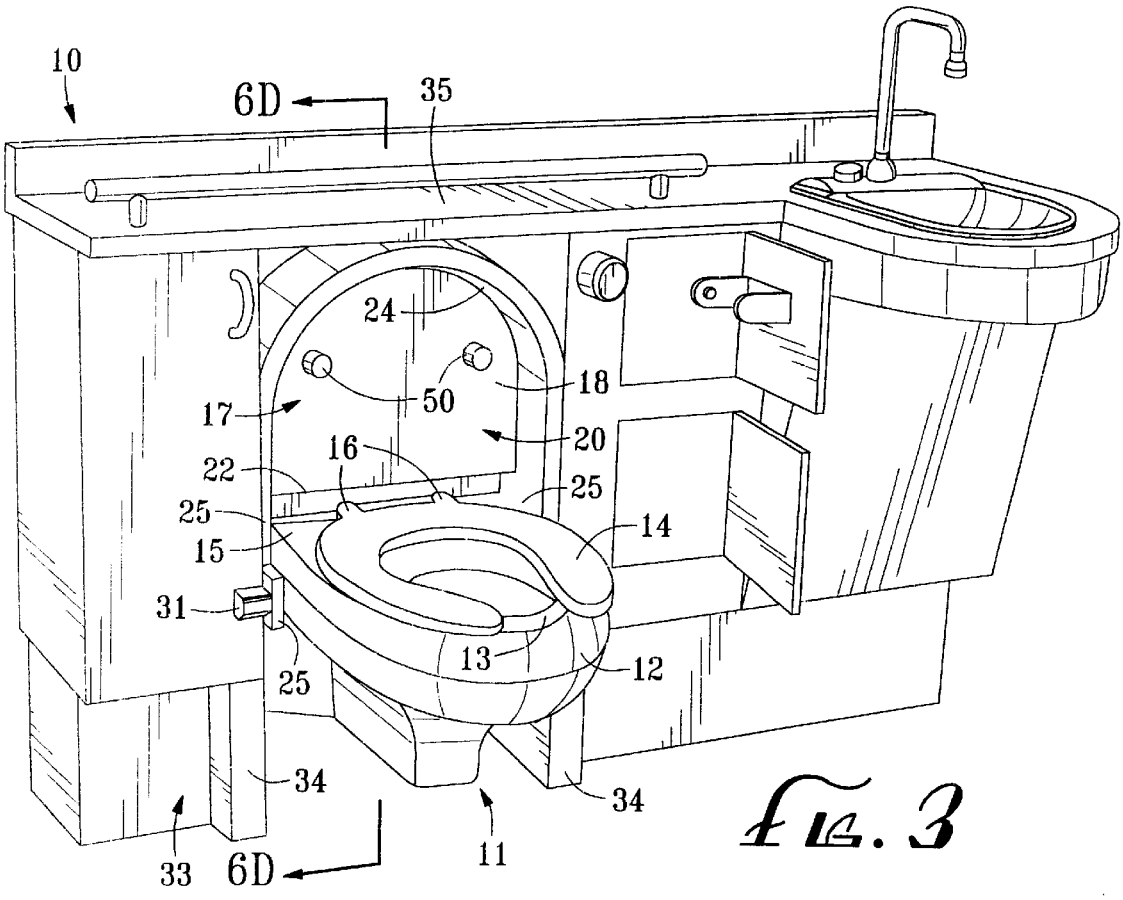
FIG. 3 is a perspective view of the first preferred embodiment of the toilet seat cover assembly in the open position.
Figure 4:
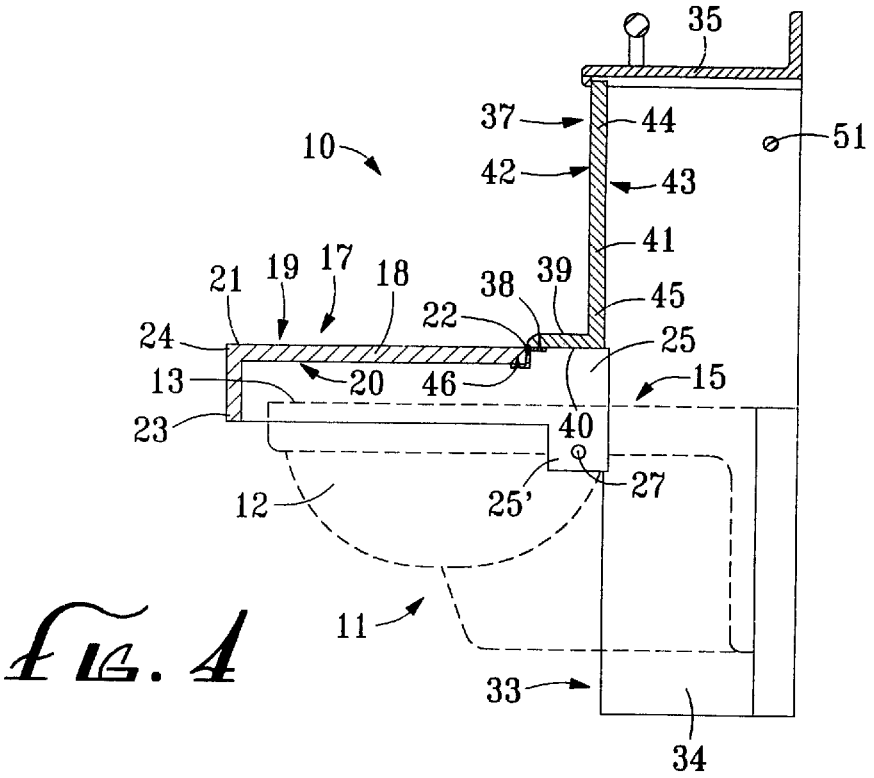
FIG. 4 is a cross-sectional view of the first preferred embodiment of the toilet seat cover assembly taken along the line of 4—4 of FIG. 1.
Figure 6A:
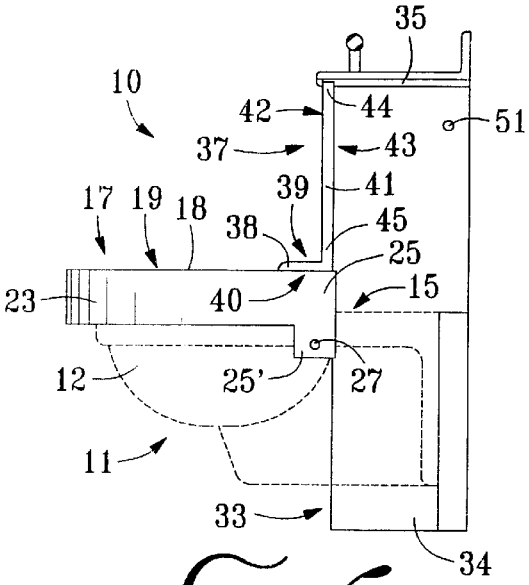
FIG. 6A is a side view of the first preferred embodiment of the toilet seat cover assembly in the closed position.
Figure 6B:
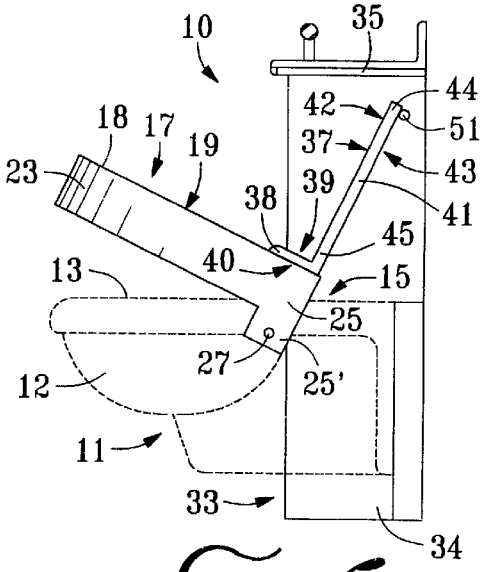
FIG. 6B is a side view of the first preferred embodiment of the toilet seat cover assembly in a partially open position with the backrest just contacting the stopper.
Figure 6C:
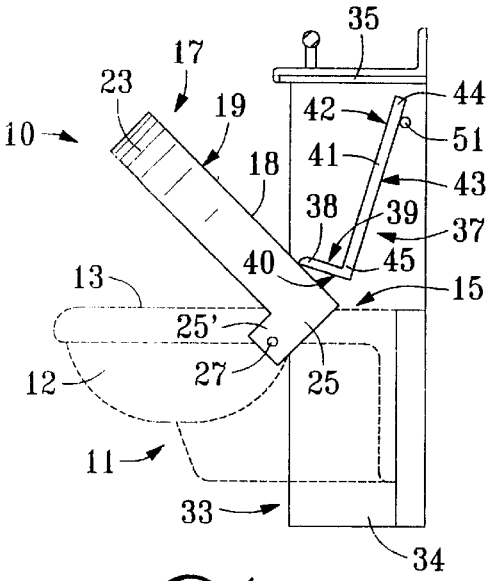
FIG. 6C is a side view of the first preferred embodiment of the toilet seat cover assembly in a further partially open position from FIG. 6B with the stopper pivoting the backrest.
Figure 6D:
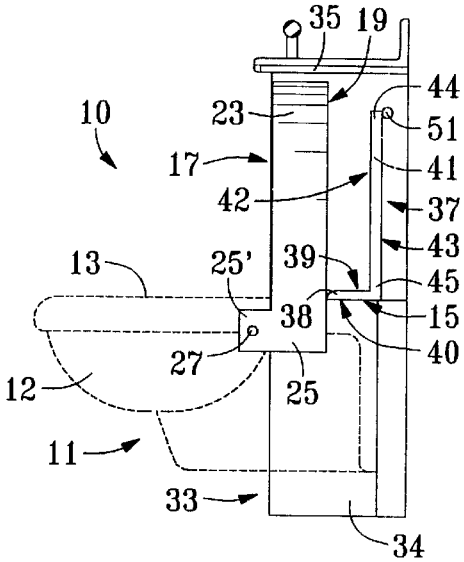
FIG. 6D is a side view of the first preferred embodiment of the toilet seat cover assembly in the fully open position.
Figure 7:
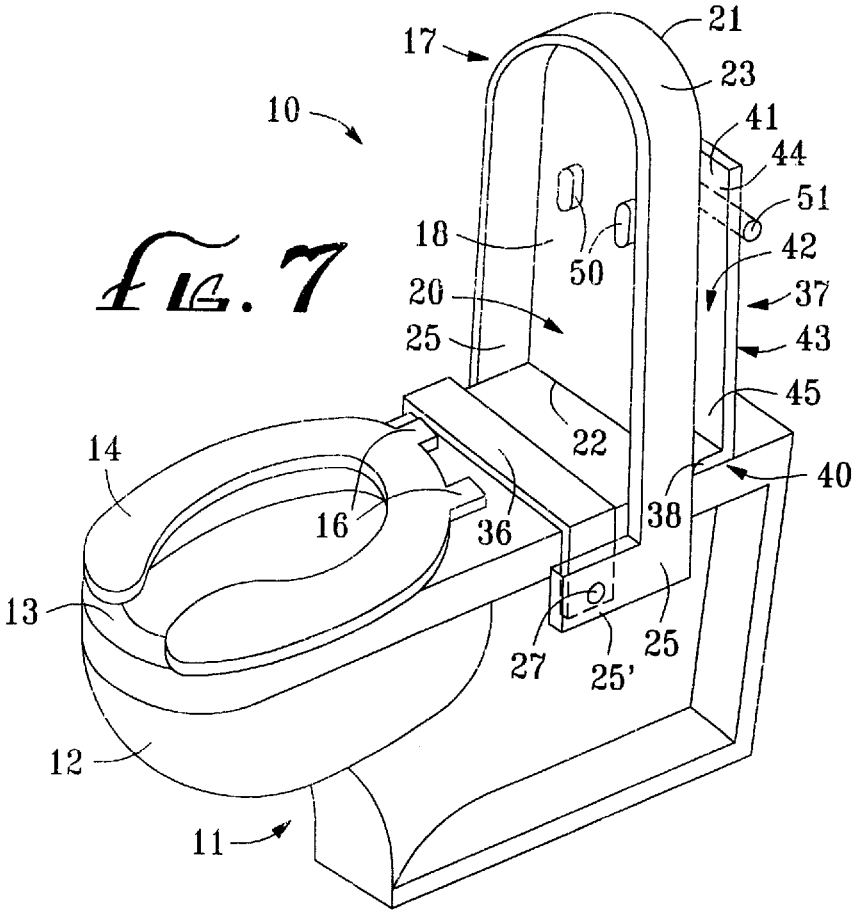
FIG. 7 is a perspective view of the second preferred embodiment of the toilet seat cover assembly in the open position.

Referring now to the drawings, FIGS. 1–4, 6A–D, and 7 show the toilet seat cover assembly, generally indicated by reference character 10, as it is used in conjunction with a toilet, generally indicated by reference character 11. FIGS. 1, 2, 4, and 6A show the toilet seat cover assembly 10 in a closed position, and FIGS. 3, 6D, and 7 show the toilet seat cover assembly 10 in a fully open position. As can be best seen in FIGS. 3 and 7, the toilet 11 includes a toilet bowl 12, a toilet bowl rim 13, and a toilet seat 14 hingedly secured to a rearward portion 15 of the toilet 11 by hinges 16.

The toilet seat cover assembly 10 has a cover, generally indicated by reference character 17 (FIGS. 1–8), having a platform portion 18 with a top surface 19 and a bottom surface 20. Preferably, the platform portion 18 has an outer rim 21 (FIGS. 1, 2, 4, and 7) which follows the contour of the toilet seat 14 and toilet bowl rim 13, and a linear rear rim 22 (FIGS. 3–4, 7, and 8) near the rearward portion 15 of the toilet 11. The cover 17 also includes a perimeter sidewall portion 23 having a pair of ends 25 and a top edge 24 joined to the platform portion 18. Preferably the top edge 24 is joined to the platform portion 18 at the outer rim 21 (FIGS. 1, 2, 4, and 7), with the perimeter sidewall portion 23 and the platform portion 18 integrally formed together as a single unit. Preferably still, the cover 17 also includes at least two cover support members 50 (FIGS. 3 and 7) affixed to the bottom surface 20 of the platform portion 18 which contacts the toilet seat 14 when in the closed position. Together with the means for hingedly securing the cover 27 (see FIGS. 5 and 8), the cover support members 50 function to support the weight of a person sitting on the toilet seat cover assembly 10. The cover support members are composed of a suitably rigid material capable of supporting the weight of a person, such as molded plastic, or dense elastomeric material.

In a first preferred embodiment (FIGS. 1–6D) the toilet seat cover assembly 10 also includes a housing structure, generally indicated by reference character 33, to which the cover 17 is hingedly secured. The housing structure 33 has a pair of vertical sidewalls 34 positioned on opposite sides of the toilet 11 near the rearward portion 15 and rigidly joined together by a connector wall 35.

Figure 5:
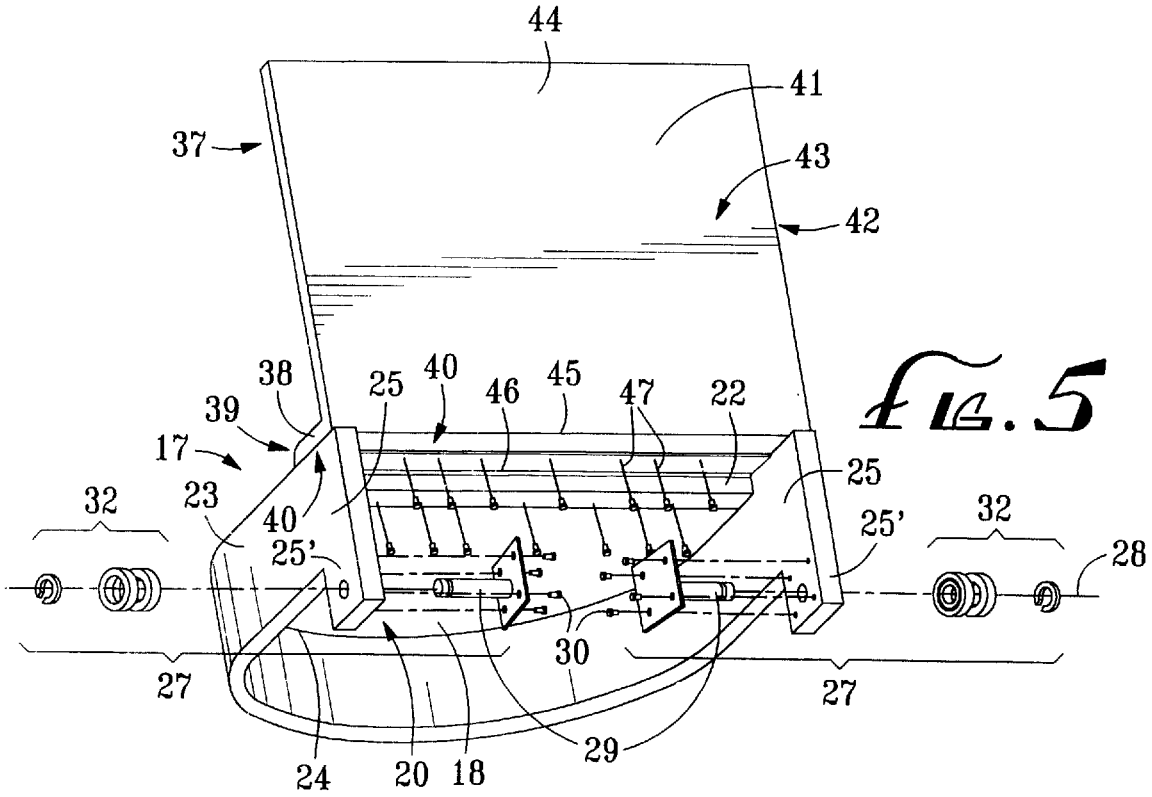
FIG. 5 is a perspective exploded view of the first preferred embodiment of the toilet seat cover assembly as generally seen from the rear underside.

In this first embodiment, as shown in FIGS. 1–4, and 6A–D, the cover 17 is hingedly secured to the pair of vertical sidewalls 34 by means for hingedly securing the cover 27 to the pair of vertical sidewalls 34. As can be best seen in FIG. 5, the means for hingedly securing the cover 27 to the pair of vertical sidewalls 34 has a pivot axis 28 extending through the pair of ends 25 of the perimeter sidewall portion 23, and preferably through downward extensions 25' of the pair of ends 25. The pivot axis 28 is also parallel to a pivot axis (not illustrated) of the hinged toilet seat 14 (FIG. 3). Preferably, the means for hingedly securing the cover 27 to the pair of vertical sidewalls 34 comprises a pair of pivot pins 29 secured to the pair of ends 25 via a plurality of fasteners 30. As shown in FIG. 5, the pair of pivot pins 29 extend outward in opposite directions through the pair of ends 25 and pivotally mount on a pair of support enclosures 31 (FIGS. 1–3) fixedly secured on the pair of vertical sidewalls 34. Preferably the pair of pivot pins 29 pivotally mount on the pair of support enclosures 31 by bearing means 32 to ensure smooth and durable hinging movement.

As can be seen in FIGS. 1–3, the housing structure 33 of the first preferred embodiment can be a modular component of a larger structure, such as a universal fixture unit. In this manner, the toilet seat cover assembly 10 can be specifically integrated into the design of a bathroom to serve an important ergonomic and/or space-conserving purpose and decor.

As can be seen in FIG. 7 a second preferred embodiment of the toilet seat cover assembly 10 is shown hingedly securing the cover 17 to the toilet 11 by means for hingedly securing the cover 27 to the toilet 11. As can be best seen in FIG. 8, and similar to the first preferred embodiment shown in FIG. 5, the means for hingedly securing the cover 27 to the toilet 11 has a pivot axis 28 preferably extending through the downward extensions 25' of the pair of ends 25 of the perimeter sidewall portion 23. And the pivot axis 28 is also parallel to a pivot axis (not illustrated) of the hinged toilet seat 14 (FIG. 7). Preferably, and similar to the first preferred embodiment, the means for hingedly securing the cover 27 to the toilet 11 also comprises a pair of pivot pins 29 secured to the pair of ends 25 via a plurality of fasteners 30. However, unlike the first preferred embodiment (FIG. 5), the pair of pivot pins 29 (FIG. 8) extend inward through the pair of ends 25 toward the toilet 11 and each other to pivotally secure to the toilet 11. In one embodiment the means for hingedly securing the cover 27 to the toilet 11 includes a C-shaped bracket 36 (FIG. 7) having an aperture at each end and mounted on the rearward portion 15 of the toilet 11. The pivot pins 29 can thus extend through the apertures of the C-shaped bracket 36 to pivotally secure the cover 17 to the toilet 11.

The toilet seat cover assembly 10 also includes a backrest, generally indicated by reference character 37, having a base portion 38 with an upper surface 39 and a lower surface 40, and an upright portion 41 with a front surface 42, a rear surface 43, an upper end 44, and a lower end 45 joined to the upper surface 39 of the base portion 38. Preferably the upright portion 41 forms a generally L-shaped cross-section with the base portion 38. However, the upright portion 41 can be joined anywhere on the upper surface 39 of the base portion 38.

Figure 8:
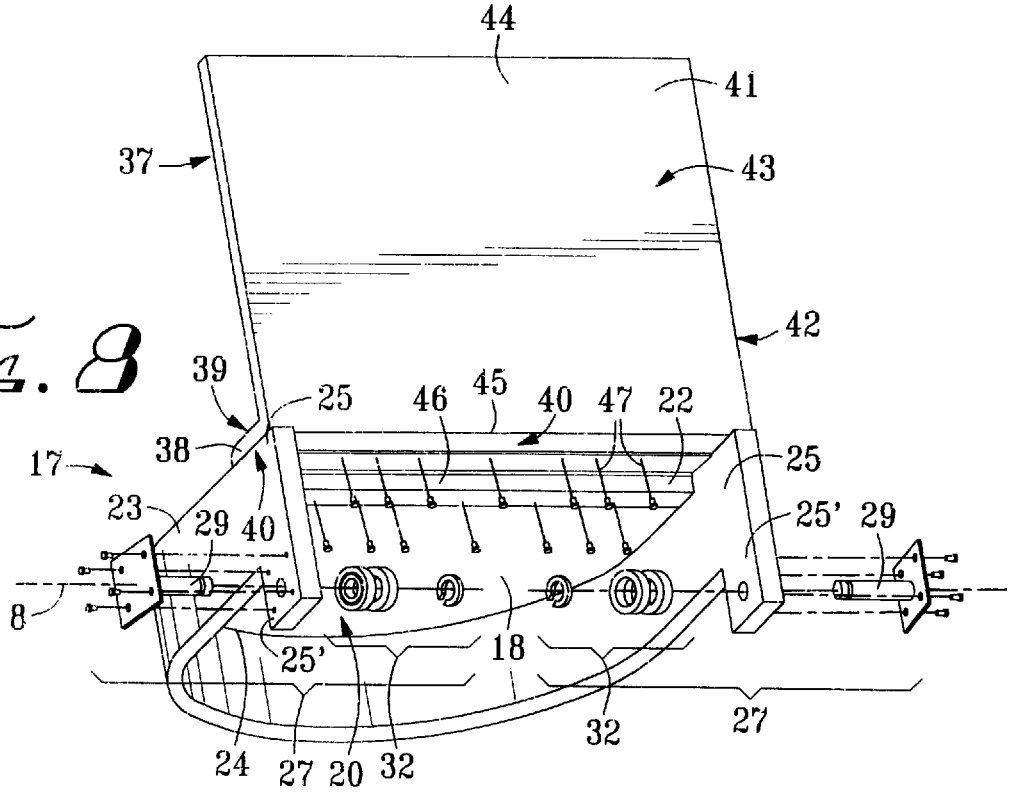
FIG. 8 is a perspective exploded view of the second preferred embodiment of the toilet seat cover assembly as generally seen from the rear underside.

As can be best seen in FIGS. 5 and 8, the base portion 38 is hingedly secured to the cover 18 by backrest hinging means 46, and contacts the cover 18 along the lower surface 40 when in the closed position. The backrest hinging means 46 can be any suitable hinging means, such as a conventional piano hinge 46, secured with a plurality of fasteners 47. Preferably the backrest hinging means 46 functions to hingedly secure the base portion 38 to the linear rear rim 22 of the platform portion 18. And in one embodiment of the cover 17 (FIGS. 5 and 8), the pair of ends 25 of the perimeter sidewall portion 23 coextensively protrude beyond the linear rear rim 22 of the platform portion 18 to expose the top edge 24 of the perimeter sidewall portion 23 near the pair of ends 25. This enables the lower surface 40 of the base portion 38 to rest on top of the exposed top edge 24 near the pair of ends 25 when the cover 17 is in the closed position. And in the closed position, the forward position of the backrest hinging means 46 relative to the backrest 37 enables the backrest 37 to support a lateral force typically exerted by a person leaning back against the upright portion 41.

Lastly, the toilet seat cover assembly 10 also includes a means for actuating the backrest hinging means 51 when the cover is moved between the open and closed positions. Preferably, as shown in FIGS. 6A–D, and 7, the means for actuating the backrest hinging means 51 is a stopper 51 positioned near the rearward portion 15 of the toilet 11 behind the upright portion 41 and facing the rear surface 43. In the first preferred embodiment (FIGS. 6A–D), the stopper 51 is affixed between the pair of vertical sidewalls 34 of the housing structure 33.

As can be seen in FIGS. 6A–D, operation of the toilet seat cover assembly 10 involves a double-hinging movement of the cover 17 and backrest 37 when the cover 17 is handled and moved between the open and closed positions. The double-hinging movement operates in two stages: movement prior to sliding-contact with the stopper 51 (FIGS. 6A–B), and movement during sliding-contact with the stopper 51 (FIGS. 6C–D).

In the first stage (FIGS. 6A–B), as the cover is initially raised from the closed position, the backrest 37 pivots together with the cover 17 about the pivot axis 28. During the first stage the lower surface 40 of the base portion 38 continues to remain in contact with the cover 17 up until the rear surface 43 comes into contact with the stopper 51 (FIG. 6B).

The second stage begins when the upper end 44 of the rear surface 43 comes into contact with the stopper (FIG. 6B) and the stopper prevents the upper end 44 of the backrest 37 from retracting further. During the second stage the stopper 51 functions to actuate the backrest hinging means 46 by effectively keeping the upper end 44 of the backrest 37 stationary while the top surface 19 of the cover 17 is raised to approach the backrest 37 (FIG. 6C). The point of contact between the rear surface 43 of the upright portion 41 and the stopper 51 is characteristically a roll-slide contact point having two degrees of freedom. The roll-slide character of the contact enables the backrest 37 to slide against the stopper 51, as well as pivot or "roll" relative to it. The cover 17 is continually raised until the base portion 38 fully contacts and rests on the rearward portion 15 of the toilet 11 along its lower surface 40. In both the first and second preferred embodiments, the stopper 51 functions to position the upright portion 41 generally parallel to the cover 17 when in the fully open position and generally perpendicular to the cover 17 when in the closed position. Additionally, the downward extensions 25' of the pair of ends serve to retract the cover 17 further back towards the rearward portion 15 of the toilet 11 when pivoted to the open position. In this manner, the toilet seat cover assembly 10 can be used as an auxiliary bathroom chair while it functions to cover the toilet bowl 12 and toilet seat 14 as would a conventional toilet seat cover. And the toilet seat cover assembly 10 does not interfere with the conventional operation and use of the toilet seat 14 when moved to the open position. In particular, the toilet seat cover assembly 10 will not interfere with the underlying hinging movement of the toilet seat 14, and the toilet seat 14 can still be raised and propped up in an upright position.

The toilet seat cover assembly 10 is preferably constructed from durable plastic or similarly rigid material. Additionally, as shown in FIGS. 1 and 2, padding 48 and 49 can be affixed to the top surface 19 of the platform portion 18 and the front surface 41 of the upright portion 40, respectively, to improve the comfort level of the toilet seat cover assembly 10 even further.

The terms "generally parallel orientation" and "generally perpendicular orientation" of the upright portion 41, as used herein, are understood to define approximations of the angular relationship between the upright portion 41 of the backrest 37 and the platform portion 18 of the cover 17 at the fully open and closed positions, respectively. The actual angle measure between the upright portion 41 and the platform portion 18 in the open and closed positions can fall within an acceptable range of ±20 degrees from true parallel or true perpendicular, respectively.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A toilet seat cover assembly for use with a toilet having a hinged toilet seat, said toilet seat cover assembly comprising:

a housing structure having a pair of vertical sidewalls positioned on opposite sides of the toilet and rigidly joined together by a connector wall;

a cover having a platform portion with a top surface, and a bottom surface, and a perimeter sidewall portion below the bottom surface of the platform portion, said perimeter sidewall portion having a pair of ends and a top edge joined to the platform portion;

means for hingedly securing the cover to the pair of vertical sidewalls having a pivot axis extending through the pair of ends of the perimeter sidewall portion and parallel to a pivot axis of the hinged toilet seat, for pivoting the cover between a closed position over the hinged toilet seat and an open position remotely pivoted away from the hinged toilet seat;

a backrest having a base portion hingedly secured to the cover by backrest hinging means, the base portion having an upper surface, and a lower surface contacting the cover when in the closed position, and an upright portion having a front surface, a rear surface, an upper end, and a lower end joined to the upper surface of the base portion; and means for actuating the backrest hinging means when the cover is moved between the open and closed positions, said means for actuating the backrest hinging means positioning the upright portion in a generally parallel orientation relative to the platform portion in the open position, and positioning the upright portion in a generally perpendicular orientation relative to the platform portion in the closed position.

2. A toilet cover assembly as in claim 1, wherein the pair of ends of the perimeter sidewall portion coextensively protrudes beyond the platform portion thereby exposing the top edge of the perimeter sidewall portion near the pair of ends; and wherein the lower surface of the base portion contacts the top edge of the perimeter sidewall portion near the pair of ends when the cover is in the closed position.

3. A toilet cover assembly as in claim 1, wherein the means for actuating the backrest hinging means is a stopper having an elongated configuration with a central axis parallel to the backrest hinging means, said stopper positioned behind the upright portion facing the rear surface and affixed between the pair of vertical sidewalls of the housing structure, the rear surface of the upright portion thereby coming into sliding contact with the stopper when the cover is moved between the open and closed positions.

4. A toilet cover assembly as in claim 1, wherein the cover has at least two cover support members affixed to the bottom surface of the platform portion, the support members for supporting the cover against the hinged toilet seat when the cover is in the closed position.

5. A toilet seat cover assembly (10) for use with a toilet (11) having a hinged toilet seat (14), said toilet seat cover assembly comprising:

a housing structure having a pair of vertical sidewalls (34) positioned on opposite sides of the toilet;

a toilet seat cover (17) having a platform portion (18) with a top surface (19), a bottom surface (20), and a rear rim (22), and a pair of side flanges (25') extending below the platform portion (18) adjacent said rear rim (22), said pair of side flanges (25') adapted to pivot about a toilet seat cover pivot axis which is supported in a fixed position with respect to said pair of vertical sidewalls (34), wherein the toilet seat cover (17) pivots between a closed position over the hinged toilet seat (14) and an open position remotely pivoted away from the hinged toilet seat (14);

a backrest (37) having a base portion (38) hingedly secured to the toilet seat cover (17) by backrest hinging means (46), and an upright portion (41) having a front surface (42), a rear surface (43), an upper end (44), and a lower end (45) joined to the base portion (38), said base portion (38) adapted to be supported by a base support force when the toilet seat cover (17) is in the closed position, said base support force countering a pivot moment produced when a lateral force is applied against the front surface (42) of the upright portion (41); and means for actuating the backrest hinging means (46) when the toilet seat cover (17) is moved between the open and closed positions, said means for actuating the backrest hinging means (46) positioning the upright portion (41) in a substantially parallel orientation relative to the platform portion (18) in the open position, and positioning the upright portion (41) in a substantially perpendicular orientation relative to the platform portion (18) in the closed position.

* * * * *